United States Patent [19]

Mangel

[11] 4,015,688

[45] Apr. 5, 1977

[54] MASTER DOOR OPERATOR FOR VERTICALLY MOVABLE ELEVATOR GATES AND LANDING DOORS

[76] Inventor: Karl Mangel, 4709 B Church St., Skokie, Ill. 60076

[22] Filed: June 23, 1975

[21] Appl. No.: 589,030

[52] U.S. Cl. ..... 187/52 LC; 49/118; 187/59

[51] Int. Cl.[2] ..... B66B 13/12

[58] Field of Search ..... 187/51, 52 R, 52 LC, 187/58, 60, 59; 49/62, 65, 73, 116, 118

[56] References Cited

UNITED STATES PATENTS

| | | | |
|---|---|---|---|
| 2,307,353 | 1/1943 | Bond | 187/52 LC |
| 2,432,293 | 12/1947 | De Giovanni | 187/52 LC |
| 2,497,080 | 2/1950 | Guilbert et al. | 187/52 LC |
| 2,633,932 | 4/1953 | Clift | 187/60 |
| 3,051,269 | 8/1962 | Guilbert et al. | 187/60 |
| 3,065,826 | 11/1962 | Tucker | 187/52 LC |
| 3,605,952 | 9/1971 | Lusti | 187/52 LC |
| 3,783,977 | 1/1974 | Voser | 187/52 LC |
| 3,921,763 | 11/1975 | Westerlund | 187/60 |

*Primary Examiner*—Evon C. Blunk
*Assistant Examiner*—Jeffrey V. Nase
*Attorney, Agent, or Firm*—Edmond T. Patnaude

[57] ABSTRACT

A drive motor on an elevator car is connected by a pivotally driven arm to a clutch mechanism on the front of a vertically movable gate which upon operation of the drive motor engages a clutch mechanism on one of the landing doors to lift the gate and landing door in synchronism.

12 Claims, 6 Drawing Figures

FIG. 1
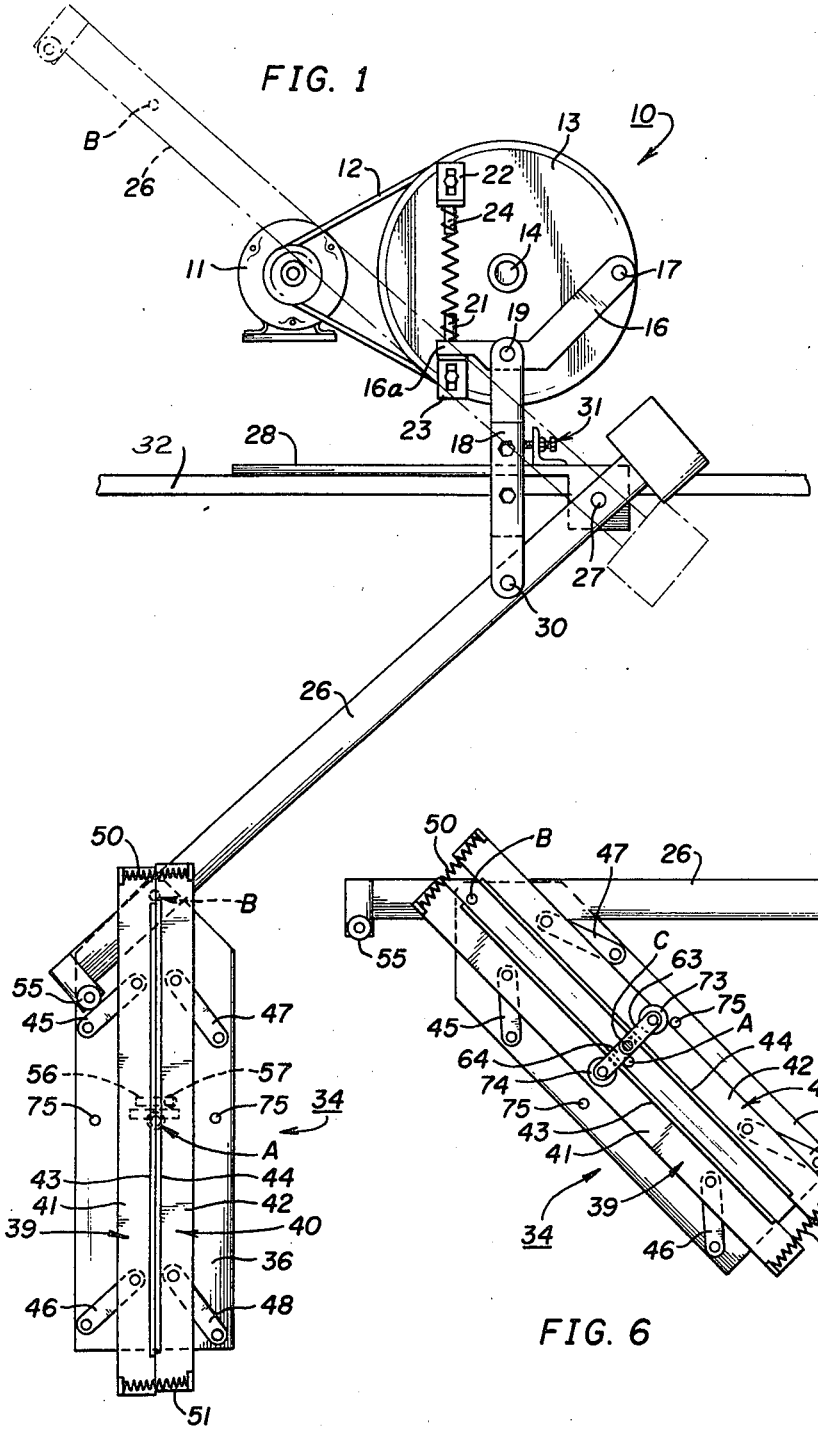
FIG. 2
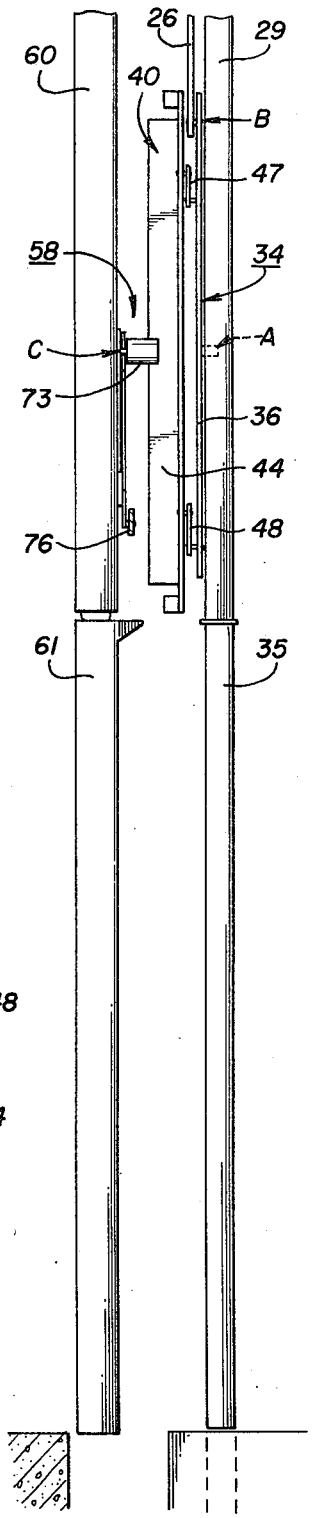
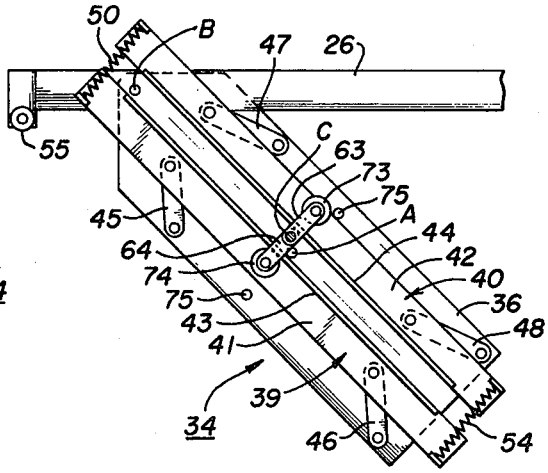
FIG. 6

MASTER DOOR OPERATOR FOR VERTICALLY MOVABLE ELEVATOR GATES AND LANDING DOORS

The present invention relates in general to mechanisms for opening and closing vertically movable elevator gates and landing doors, and it relates more particularly to a new and improved master door operator which is mounted on the elevator car and which operates the associated gates and landing doors in synchronism.

BACKGROUND OF THE INVENTION

Vertically movable elevator car gates and landing doors are commonly used in freight elevator systems. For reasons of economy it is desirable to employ a single master door operator for operating the car gates and the doors at each landing. The vertically movable car gates are usually of the bypassing two-speed type although biparting type gates are also sometimes used. With either type of gate, however, the upper gate may be driven up or down to in turn cause the other gate to be driven up or down through a chain and sprocket system. The present invention finds use with either the biparting or the bypassing vertically movable gates.

As an elevator car approaches a landing it is desirable that the gate and landing door begin to open before the car comes to a complete stop. This is known in the art as advance door opening and is an advantageous feature of any elevator system because of the savings in time. It is also desirable that the gates and landing doors open and close in mutual synchronism. Both of these features are provided by the present invention. Moreover, the speed at which the gates and doors are opened and closed by the master door operator of the present invention follows one-hundred eighty degrees of a sine wave whereby the gates and doors move slowly away from and slowly into the fully open and closed positions.

SUMMARY OF THE INVENTION

Briefly, there is provided in accordance with the present invention a master door operator which is mounted to the elevator car and which functions to open the car gate, actuate the landing door interlock and lift the landing door as the car approaches a landing at which it is to stop. Prior to the car leaving a landing, the gates and landing doors are closed and the landing doors are locked in a closed position by the same door operator mechanism. The operator comprises a pivotally mounted drive arm which extends across the front of the gate and is pivotally connected to a lifting clutch mechanism which is in turn pivotally mounted to the upper car gate on the vertical centerline thereof. Pivotally mounted to each upper landing door is an interlock actuating and clutch mechanism including a pair of rollers which are pressed apart by the clutch mechanism to release the landing door interlock and which are simultaneously pivoted relative to the landing door so that a lifting force may be transmitted from the driving arm through the clutch mechanism to the landing door. As more fully explained hereinafter, as the gate is lifted by the door arm, the clutch mechanisms on the gate and doors move relative to one another in a vertical direction until theis respective pivot axes are aligned. Thereafter the gate and door are locked together by the interconnected clutch mechanisms and the door is lifted into the fully open position in substantial synchronism with the movement of the gate.

BRIEF DESCRIPTION OF THE DRAWINGS

Further objects and advantages and a better understanding of the present invention can be had by reference to the following detailed description, wherein:

FIG. 1 is an elevational view of a portion of the master door operator of the present invention;

FIG. 2 is a vertical section of a set of car gates and a set of landing doors with which the operator of the present invention is used;

FIG. 6 is an elevational view of the driving and driven clutch mechanisms about midway through a gate and door opening or closing cycle.

DETAILED DESCRIPTION OF THE INVENTION

Figure 3:
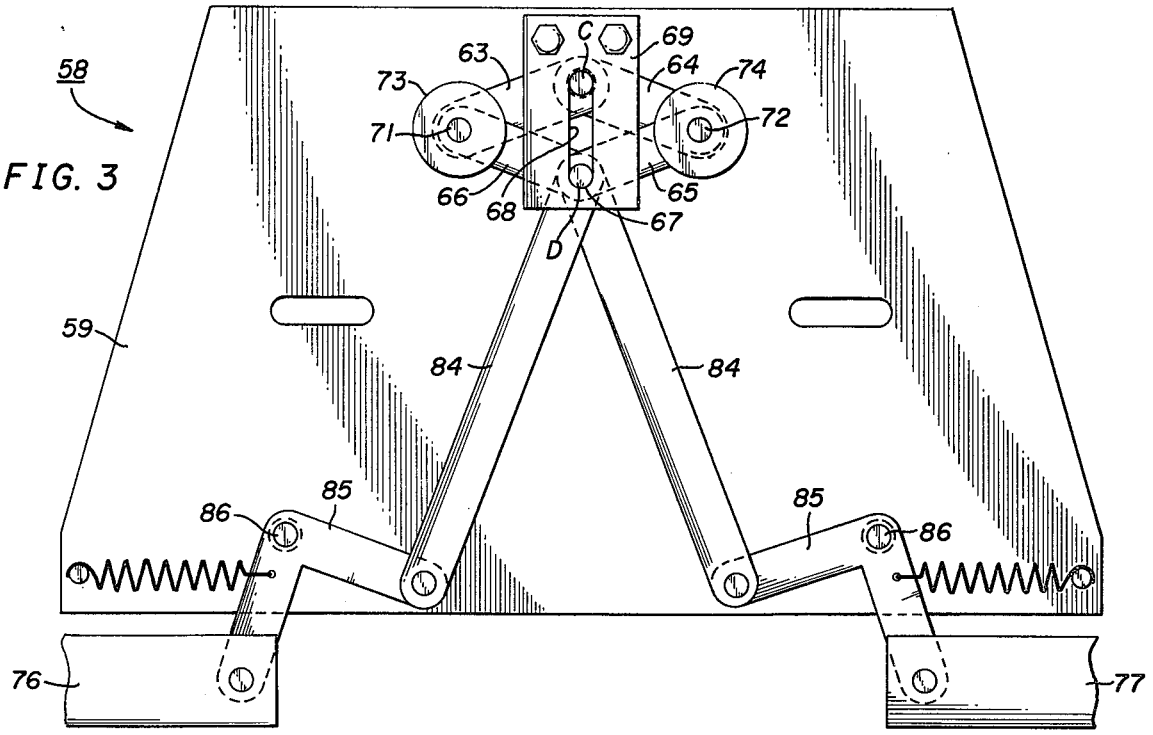
FIG. 3 is an elevational view of the driven clutch and interlock mechanism used in the door operator of the present invention.

Referring now to the drawings and particularly to FIG. 1 thereof, a driving mechanism 10 is suitably mounted to the top of an elevator car and includes a motor 11 drivingly connected by a belt 12 or the like to a circular plate 13 journaled for rotation on the shaft 14. In this embodiment of the invention the belt drive provides an overload clutch but a separate clutch or a torque motor can be used to provide the necessary slippage should the system become jammed. The plate 13 may be one face of a pulley if desired. An actuating arm 16 is pivotally mounted at 17 to the plate 13 and a connecting arm is pivotally connected to the arm 16 as shown at 19. The end **16*a* of the arm 16 is apertured to slidably receive a guide rod 21 adjustably mounted to the plate 13 by means of a pair of brackets 22 and 23. A coil spring 24 is compressed between the upper bracket 22 and the actuating arm 16 to bias the arm into the illustrated position against the lower bracket 23. During normal operation of the door operator the actuating arm remains in juxtaposition with the lower bracket 23 and the driving mechanism operates as though the connecting arm 18 were pivotally connected directly to the plate 13. However, should the motor 11 fail to operate because of a power failure of any other reason, this indirect mounting of the arm 18 to the plate 13** permits manual operation of the elevator car gate.

A driving arm 26 is pivotally mounted as shown at 27 to a base member 28 which is in turn mounted to the top of the elevator car is partially shown at 32. Preferably the entire driving mechanism 10 is mounted on the base member 28 for ease of installation and maintainence. The driving arm 26 extends downwardly across the outer face of the upper elevator gate 29 as best shown in FIG. 2 and is pivotally connected to the lower end of the arm 18 as shown at 30. An adjustable stop 31 is mounted on the base member 28 for engagement by the connecting arm 18 to set the lowermost and uppermost positions of the driving arm 26. As thus far described it may be seen that operation of the motor 11 causes the driving arm 26 to pivot about the pivot point 27 between the lowermost position shown in solid lines in FIG. 1 and an uppermost position shown in phantom.

Moreover, any given point along the arm 26 moves in an arc at a velocity varying in accordance with a sine wave.

A driving clutch mechanism 34 is connected between the driving arm 26 and the upper car gate 29 so that the arm 26 lifts and lowers the car gates. It will be understood that the lower car gate 35 (FIG. 2) is suitably connected to the upper gate 29 by means well known in the art as to follow the movement of the upper gate 29. With biparting doors as shown, the movement of the lower gate is opposite to that of the upper gate while with two speed bypassing gates, not shown, both gates move at different speeds but in the same direction.

Considering the driving clutch mechanism 34 in greater detail, it includes a base plate 36 which is pivotally connected as shown at A to the vertical centerline of the upper car gate 29. A pair of clutch plates 39 and 40 have respective base flanges 41 and 42 lying parallel to the base plates 36 and forwardly extending flanges 43 and 44. The clutch plate 39 is mounted to the base plate 36 by a pair of linkage arms 45 and 46, and the clutch plate 40 is connected to the base plate 36 by a pair of linkage arms 47 and 48. The linkage arms 45, 46, 47 and 48 are each pivotally connected at one end to the base plate and at the other end to the associated clutch plate whereby the clutch plate flanges 43 and 44 remain in mutually parallel relationship as the clutch plates swing on the respective linkage arms. A plurality of compression springs 50 and 51 are mounted between the upper and lower ends of the clutch plates 39 and 40 to urge them from the illustrated declutching position to the spaced apart clutching position shown in FIG. 6. The outer faces of the flanges 43 and 44 provide the clutching surfaces and may be covered with a suitable friction material.

Figure 5:
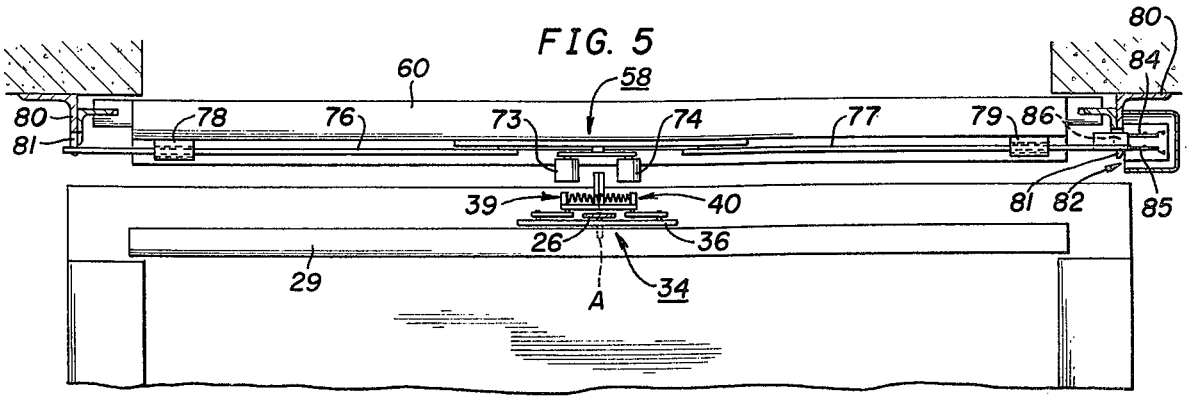
FIG. 5 is a top view of the car gates and landing doors as shown in FIG. 2.

The driving arm 26 is pivotally connected at B to the upper part of the base plate 36 and has a roller 55 mounted near the lower end for engagement with the linkage arm 45 to hold the clutch plate 41 in the inward declutched position when the arm 26 is in the lowermost position and the gate is closed. An arm 56 attached to the inner face of the clutch plate flange 41 has a roller which rides on an arm 57 attached to the inner face of the clutch plate flange 42 whereby swinging of the clutch plate 39 in a clockwise direction into the declutched position as shown in FIG. 1 drives the clutch plate 40 in a counterclockwise direction into the retracted declutched position as shown in FIG. 1 and 5. It will thus be seen that as the arm 26 is swung upwardly to open the gate, the pivot point B follows the arc of a circle having its center at the pivot point 27 about which the drive arm 26 pivots. Since the gate and thus the pivot point A can only move in a vertical direction, the clutch mechanism 34 rotates in a counterclockwise direction around point A during the first half of the gate opening cycle and in a clockwise direction during the second half of the cycle. Moreover, during the very first part of the operating cycle when the gate has lifted perhaps one-half inch, the roller 55 has been moved a sufficient distance away from the linkage arm 45 so as not to interfere with movement of the clutch plates to the fully extended positions.

In order to lift the respective ones of the landing doors at which the elevator car is coming to a stop, the upper one of each set of landing doors is provided with a driven clutch and interlock mechanism 58 which is adapted to be engaged by the driving clutch plates 39 and 40 to lift the landing door in synchronism with the car plate. Considered in greater detail, and with particular reference to FIG. 3, the driven clutch and interlock mechanism 58 comprises a mounting plate 59 suitably mounted to the inner face of the upper one of a pair of vertically movable landing doors 60 and 61. Four linkage arms 63, 64, 65 and 66 are pivotally connected together to form a parallelogram with the uppermost pivot point C being fixed to the door 60 on the vertical centerline thereof and the lowermost pivot point D being provided by a pintle 67 slidably mounted in a vertical slot 68 in a bracket 69 fixed to the door 60. The other two pivot points of the parallelogram linkage are provided by a pair of shafts 71 and 72 on which a pair of rollers 73 and 74 are respectively journaled. The rollers 73 and 74 constitute clutch members which cooperate with the clutch plates 39 and 40 to operate the landing doors. In addition, the rollers 73 and 74 function through the parallelogram linkage to operate an interlock mechanism which prevents inadvertent opening of a landing door.

Figure 4:
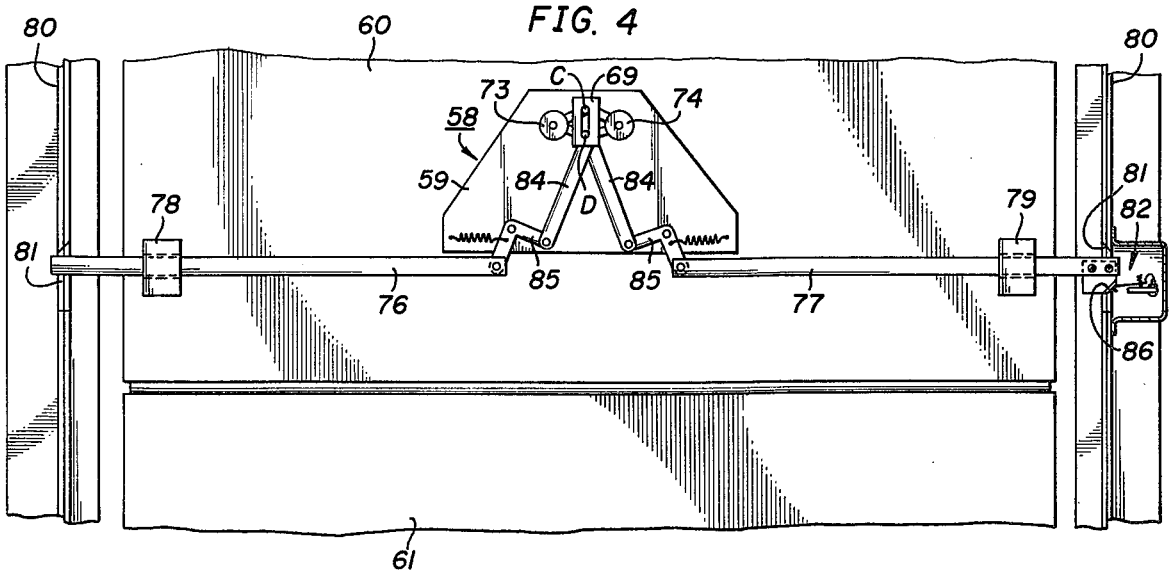
FIG. 4 is an elevational view of the inner face of a set of landing doors to which the operator of the present invention is connected.

The interlock system is best shown in FIG. 4 and comprises a pair of reciprocable locking bars 76 and 77 slidably mounted for horizontal movement in a pair of brackets 78 and 79 attached to the door. At each landing in the hoistway side plates 80 are provided with openings 81 for receiving the locking bars when they are in the extended interlocking position as shown in FIG. 4. In addition to the mechanical interlock, switch means 82 may also be mounted in the hoistway for actuation by the bar 77.

As best shown in FIGS. 4 and 5, the switch 82 includes a pair of contacts 84 and 85 which are electrically interconnected by a conductive bar 86 when the bar 77 is in the extended locking position. The bar 86 is mounted by an insulating bracket to the end portion of the bar 77 and extends into the opening 81 when the landing door is locked. The switch contacts 84 and 85 are connected in the drive circuit of the associated elevator car to prevent operation of the car unless the landing doors are locked. There is thus provided a complete mechanical and electrical interlock for the landing doors and elevator drive system.

The bars 76 and 77 are connected to the lowermost pintle 67 by respective linkages each comprising an arm 84 and a crank arm 85. The crank arms 85 are pivotally connected at 86 to the plate 59 and pivotally connected at their ends to the associated arm 84 and bar 76 or 77. The upper ends of the arms 84 are pivotally connected together and to the pintle 67 whereby upward movement of the pintle 67 retracts the locking bars 76 and 77 from the openings 81 thereby to permit opening of the landing doors 60 and 61.

OPERATION

As the elevator car approaches each landing the flanges 43 and 44 of the driving clutch mechanism 34 on the car gate pass between the rollers 73 and 74 on each upper landing door. FIG. 5 illustrates this condition with the clutch plates in the retracted declutched position. When the car is to stop at a particular landing, control means not forming any part of the present invention cause the motor 11 to be energized while the flanges 43 and 44 are between the rollers 73 and 74. Preferably, this occurs before the car has come to a complete stop. As the plate 13 is rotated by the motor 11, the arm 26 swings up in a clockwise direction to lift the gate 60. During the initial few degrees of movement of the arm 26 the roller 55 releases the clutch plates which thus move toward the clutching position under the force exerted thereon by the springs 50 and 51. Assuming that the elevator is going up wherefor the pivot point A on the gate is below pivot point C on the landing door when the clutch plates are released, the outer face of the clutch flange 43 will engage the roller 74 but because of the fact that the driving clutch is at an angle relative to the vertical the clutch flange 44 will not engage the roller 74 because the plate 40 engages its respective stop 75 on the base plate 36. Nevertheless, the force of the springs 50 and 51 transmitted through the clutch plate 39 will push the roller 74 outward to lift the pintle 67 and retract the locking bars 76 and 77. Once the pivot point D becomes coaxial with the pivot point C the locking bars 76 and 77 are fully retracted and no further movement thereof occurs. Moreover, roller 74 will roll along the flange 43 until the linkage arm 63 is perpendicular to the flange 43. Because of the parallelogram linkage, the linkage arm 64 will also move into perpendicular relationship with the flange 44. Although the gate is moving at this time no lifting force is transmitted to the landing door which thus remains stationary.

As the pivot point A on the gate approaches the pivot point C on the landing door, a substantial component of the lifting force on the driving clutch is transmitted through the clutch plate 40 to the roller 73 by virtue of the fact that the clutch flange 44 is extending at a substantial angle as shown, for example, in FIG. 6. By proper selection of the springs 50 and 51 the door begins to lift as the pivot point A on the gate approaches the pivot point C on the door although some relative slippage occurs. Once, however, the pivot points A and C are aligned no further slippage occurs and the gate and door move substantially in unison. Rotation of the driving clutch during the initial half of the lifting cycle adds a lift component to the landing door so that the gates and doors simultaneously reach the fully open positions.

When the elevator car is going down and is approaching a landing at which it is to stop, the driving clutch pivots in the same direction about pivot point A but the pivot point A on the car is above the pivot point C on the door. The operation is the same and relative slippage occurs until the pivot points A and C are aligned.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What I claim:

1. In an elevator system including an elevator car having a vertically movable gate and a plurality of vertically movable landing doors respectively located at a plurality of landings, the combination comprising a driving clutch mechanism mounted to the front of said gate for pivotal movement about a horizontal axis extending perpendicular to said gate, drive means carried by said elevator car for moving said gate between open and closed positions and for simultaneously causing said clutch mechanism to pivot about said axis, said driving clutch mechanism including a pair of first clutch members which rotate in unison about said axis, means mounting said first clutch members for lateral relative movement between declutching and clutching positions and simultaneous pivotal movement when said clutch mechanism pivots about said axis, a plurality of identical driven clutch mechanisms respectively mounted to said landing doors for respective engagement by said driving clutch mechanism, said driven clutch mechanism on each landing door being mounted for pivotal movement about a first axis extending perpendicular to the direction of movement of the associated one of said doors, said driven clutch mechanisms each including a pair of second clutch members engageable by said first clutch members when said first clutch members are in said clutching positions to rotate the engaged driven clutch mechanism in unison with the rotation of said driving clutch mechanism, whereby said drive means opens said gate and pivots said driving clutch mechanism to cause said first clutch members to move into the clutching position in engagement with said second clutch members on the adjacent door, to cause said first clutch members to pivot, to lift and to pivot said second clutch members to open said adjacent door in unison with said gate.

2. The combination set forth in claim 1 wherein said driving clutch mechanism is pivotally attached to the vertical centerline of said gate, and said driven clutch mechanisms are pivotally attached to the vertical center lines of said doors, the respective axes about which said mechanisms are pivoted being equally spaced from corresponding edges of said gate and said doors.

3. The combination set forth in claim 1 wherein said drive means comprises, a drive arm pivotally mounted to said car for arcuate movement in a plane parallel to the plane in which said gate moves, and motor means mounted to said car and connected to said drive arm for pivoting said arm between open and closed positions.

4. The combination set forth in claim 3 wherein said first clutch members are spring loaded toward a clutching position.

5. The combination set forth in claim 1 where each of said driven clutch mechanisms comprises a parallelogram linkage pivotally mounted to the associated door, and a said second clutch members are carried by said linkage at opposite pivot points thereof are respective engagement by said clutch plates when said clutch plates are in a clutching position.

6. The combination set forth in claim 1 wherein said means mounting said first clutch members comprises a base member pivotally mounted to said gate, a first plurality of parallel linkage arms each pivotally connected at one end to said base member and at the other end to one of said first clutch members, and a second plurality of parallel linkage arms each pivotally connected at one end to said base member and at the other end to the other of said first clutch members.

7. The combination set forth in claim 1 further comprising a plurality of landing door interlock means for locking each set of landing doors, and coupling means coupling said driven clutch mechanism to said interlock means to release said interlock means in response to rotation of said driving clutch mechanism.

8. The combination set forth in claim 7 wherein each driven clutch mechanism includes a first pair of arms pivotally connected on said first axis to said door and respectively connected to said second clutch members, a second pair of arms connected together at one end for pivotal movement about a second axis, and respectively connected at the other ends to said clutch members, and guide means for limiting the movement of said second axis to a vertical direction.

9. The combination set forth in claim 8 wherein said coupling means comprises a pair of crank arms pivotally connected to said door, and means biasing said interlock toward an interlocked position.

10. The combination according to claim 1 wherein said second clutch members are rollers, and means mounting said rollers in spaced apart relationship for pivotal movement about said first axis disposed between said rollers.

11. In an elevator including an elevator car having a vertically movable gate and a plurality of vertically movable landing doors at a plurality of landings, comprising driving clutch means pivotally mounted to said gate for limited rotation in a vertical plane, said clutch means including first and second clutch plates, spring means mounted between said clutch plates for biasing said plates apart, a plurality of driven clutch means pivotally mounted to respective ones of said doors, said driven clutch means including a pair of clutch members, a parallelogram linkage carrying said clutch members in spaced apart relationship for movement of said clutch plates therebetween, and driving means carried by said elevator car including a pivotally mounted arm for lifting and rotating said driving clutch means, and means operative upon operation of said driving means for causing said clutch plates to move apart into engagement with said clutch members, whereby said gate and said doors are opened in synchronism by said driving means.

12. In an elevator including an elevator car having a vertically movable gate and a plurality of vertically movable landing doors at a plurality of landings, comprising driving clutch means pivotally mounted to said gate for limited rotation in a vertical plane, said clutch means including first and second clutch plates, a plurality of driven clutch means pivotally mounted to respective ones of said doors, said driven clutch means including a pair of clutch members, means carrying said clutch members in spaced apart relationship for movement of said clutch plates therebetween, driving means carried by said elevator car including a pivotally mounted arm for lifting and rotating said plates, and means operative upon rotation of said driving means for causing said clutch plates to move apart into engagement with said clutch members, whereby said gate and said doors are opened in synchronism by said driving means.

* * * * *